US010526678B2

(12) United States Patent
Kizu et al.

(10) Patent No.: US 10,526,678 B2
(45) Date of Patent: Jan. 7, 2020

(54) HIGH-STRENGTH THIN STEEL SHEET AND METHOD FOR MANUFACTURING THE SAME

(71) Applicant: JFE STEEL CORPORATION, Chiyoda-ku, Tokyo (JP)

(72) Inventors: Taro Kizu, Tokyo (JP); Shunsuke Toyoda, Tokyo (JP); Akimasa Kido, Tokyo (JP); Tetsushi Tadani, Tokyo (JP)

(73) Assignee: JFE STEEL CORPORATION, Chiyoda-ku, Tokyo (JP)

( * ) Notice: Subject to any disclaimer, the term of this patent is extended or adjusted under 35 U.S.C. 154(b) by 187 days.

(21) Appl. No.: 15/574,838

(22) PCT Filed: Jul. 5, 2016

(86) PCT No.: PCT/JP2016/003207
§ 371 (c)(1),
(2) Date: Nov. 17, 2017

(87) PCT Pub. No.: WO2017/006563
PCT Pub. Date: Jan. 12, 2017

(65) Prior Publication Data

US 2018/0155806 A1 Jun. 7, 2018
US 2018/0371574 A9 Dec. 27, 2018

(30) Foreign Application Priority Data

Jul. 6, 2015 (JP) ..... 2015-135432

(51) Int. Cl.

| | |
|---|---|
| ***C21D 9/46*** | (2006.01) |
| ***C21D 8/02*** | (2006.01) |
| ***C21D 7/13*** | (2006.01) |
| ***C21D 6/00*** | (2006.01) |
| ***C21D 1/18*** | (2006.01) |
| ***C22C 38/06*** | (2006.01) |
| ***C22C 38/02*** | (2006.01) |
| ***C22C 38/38*** | (2006.01) |
| ***C22C 38/28*** | (2006.01) |
| ***C22C 38/24*** | (2006.01) |
| ***C22C 38/00*** | (2006.01) |
| ***B21B 1/22*** | (2006.01) |

(52) U.S. Cl.
CPC ..... *C21D 9/46* (2013.01); *B21B 1/22* (2013.01); *C21D 1/18* (2013.01); *C21D 6/005* (2013.01); *C21D 6/008* (2013.01); *C21D 7/13* (2013.01); *C21D 8/0205* (2013.01); *C21D 8/0226* (2013.01); *C21D 8/0263* (2013.01); *C22C 38/001* (2013.01); *C22C 38/002* (2013.01); *C22C 38/02* (2013.01); *C22C 38/06* (2013.01); *C22C 38/24* (2013.01); *C22C 38/28* (2013.01); *C22C 38/38* (2013.01); *B21B 2001/225* (2013.01); *C21D 2211/004* (2013.01); *C21D 2211/005* (2013.01)

(58) Field of Classification Search
CPC ..... B21B 1/22; B21B 2001/225; B21B 3/00; C21D 1/18; C21D 2211/004; C21D 2211/005; C21D 6/005; C21D 6/008; C21D 7/13; C21D 8/0205; C21D 8/0226; C21D 8/0263; C21D 9/46; C22C 38/00; C22C 38/001; C22C 38/002; C22C 38/005; C22C 38/02; C22C 38/04; C22C 38/06; C22C 38/12; C22C 38/14; C22C 38/24; C22C 38/28; C22C 38/38; C22C 38/42; C22C 38/44; C22C 38/46; C22C 38/48; C22C 38/50; C22C 38/58; C22C 38/60
See application file for complete search history.

(56) References Cited

U.S. PATENT DOCUMENTS

| | | | |
|---|---|---|---|
| 9,200,342 | B2 | 12/2015 | Yokoi et al. |
| 9,212,411 | B2 | 12/2015 | Nakagawa et al. |
| 9,738,960 | B2 | 8/2017 | Kizu et al. |
| 9,765,413 | B2 | 9/2017 | Kawasaki et al. |
| 2014/0000766 | A1 | 1/2014 | Maeda et al. |
| 2014/0178712 | A1 | 6/2014 | Maruyama et al. |
| 2015/0315683 | A1 | 11/2015 | Maeda et al. |
| 2018/0016657 | A1 | 1/2018 | Kizu et al. |

FOREIGN PATENT DOCUMENTS

| | | | |
|---|---|---|---|
| CN | 102471844 | A | 5/2012 |
| CN | 102959114 | A | 3/2013 |
| CN | 103003460 | A | 3/2013 |
| CN | 104254632 | A | 12/2014 |
| CN | 107406937 | A | 11/2017 |
| EP | 2014781 | A1 | 1/2009 |

(Continued)

OTHER PUBLICATIONS

Dec. 5, 2018, Office Action issued by the State Intellectual Property Office in the corresponding Chinese Patent Application No. 201680039917.X with English language search report.

(Continued)

*Primary Examiner* — Jenny R Wu

(74) *Attorney, Agent, or Firm* — Kenja IP Law PC

(57) ABSTRACT

This disclosure provides a predetermined composition, where a conversion value C* of total carbon contents in Ti, Nb and V precipitates whose grain sizes are less than 20 nm is 0.010 mass % to 0.100 mass %, Fe content in Fe precipitates is 0.03 mass % to 0.50 mass %, and an average grain size of ferrite grains whose grain sizes are top 5 % large in ferrite grain size distribution of rolling direction cross section is $(4000/TS)^2$ μm or less, the TS indicating tensile strength in unit of MPa.

12 Claims, 4 Drawing Sheets

(56) References Cited

FOREIGN PATENT DOCUMENTS

| | | | |
|---|---|---|---|
| EP | 3266897 | A1 | 1/2018 |
| JP | 2008261029 | A | 10/2008 |
| JP | 2009167475 | A | 7/2009 |
| JP | 2009293067 | A | 12/2009 |
| JP | 2014043630 | A | 3/2014 |
| JP | 2014098210 | A | 5/2014 |
| WO | 2013022043 | A1 | 2/2013 |
| WO | 2014091554 | A1 | 6/2014 |

OTHER PUBLICATIONS

Mar. 15, 2018, Extended European Search Report issued by the European Patent Office in the corresponding European Patent Application No. 16821038.3.

Aug. 27, 2019, Office Action issued by the China National Intellectual Property Administration in the corresponding Chinese Patent Application No. 201680039917.X with English language Concise Statement of Relevance.

Sep. 13, 2016, International Search Report issued in the International Patent Application No. PCT/JP2016/003207.

HIGH-STRENGTH THIN STEEL SHEET AND METHOD FOR MANUFACTURING THE SAME

TECHNICAL FIELD

This disclosure relates to a high-strength thin steel sheet having excellent blanking workability and toughness which are suitable for applications, for example, suspension parts such as lower arms and frames, frameworks such as pillars and members as well as their reinforcing members, door impact beams, and seat members of automobiles, and structural members for vending machines, desks, consumer electrical appliances, office automation equipment, building materials, and the like. This disclosure also relates to a method for manufacturing the high-strength thin steel sheet.

BACKGROUND

In recent years, responding to increasing public concern about global environment issues, there has been a growing demand for, for example, curbing use of thick steel sheets which necessitate relatively large $CO_2$ emission during manufacturing of the steel sheets. Furthermore, in the automobile industry, there has been a growing demand for, for example, lighter-weight vehicles which improve a fuel consumption rate while reducing exhaust gas. For these reasons, steel sheets have been made stronger and thinner.

High-strength steel sheets generally have poor blanking workability and toughness. Therefore, it is desired to develop a high-strength thin which can be used for parts molded by press blanking or for parts requiring toughness or, particularly, for parts that are molded by press punching and require toughness at the same time.

For example, JP 2008-261029 A (PTL 1) describes a steel sheet excellent in blanking workability, which is "a high-strength hot rolled steel sheet excellent in blanking workability, comprising, in mass %, C: 0.010% to 0.200%, Si: 0.01% to 1.5%, Mn: 0.25% to 3%, controlling P to 0.05% or less, further comprising at least one of Ti: 0.03% to 0.2%, Nb: 0.01% to 0.2%, V: 0.01% to 0.2%, and Mo: 0.01% to 0.2%, the balance consisting of Fe and inevitable impurities, and a segregation amount of C at large-angle crystal grain boundaries of ferrite being 4 atms/nm$^2$ to 10 atms/nm$^2$".

Additionally, WO 2013/022043 (PTL 2) describes a steel sheet excellent in toughness, which is a "high yield ratio hot rolled steel sheet which has an excellent low temperature impact energy absorption and HAZ softening resistance characterized by comprising, by mass %, C: 0.04% to 0.09%, Si: 0.4% or less, Mn: 1.2% to 2.0%, P: 0.1% or less, S: 0.02% or less, Al: 1.0% or less, Nb: 0.02% to 0.09%, Ti: 0.02% to 0.07%, and N: 0.005% or less, a balance of Fe and unavoidable impurities, where 2.0≤Mn+8[% Ti]+12[% Nb]2.6, and having a metal structure which comprises an area percentage of pearlite of 5% or less, a total area percentage of martensite and retained austenite of 0.5% or less, and a balance of one or both of ferrite and bainite, having an average grain size of ferrite and bainite of 10 μm or less, having an average grain size of alloy carbonitrides with incoherent interfaces which contain Ti and Nb of 20 nm or less, having a yield ratio of 0.85 or more, and having a maximum tensile strength of 600 MPa or more".

CITATION LIST

Patent Literature

PTL 1: JP 2008-261029 A
PTL 2: WO 2013/022043

SUMMARY

Technical Problem

However, for the steel sheet described in PTL 1, conditions required for excellent toughness such as the grain size of precipitates were not taken into consideration, and there was a problem that excellent blanking workability and toughness could not be compatibly attained.

Additionally, for the steel sheet described in PTL 2, conditions required for excellent blanking workability were not taken into consideration, and there was also a problem that excellent blanking workability and toughness could not be compatibly attained.

To solve the above problems, it could be helpful to provide a high-strength thin steel sheet having both of excellent blanking workability and excellent toughness, as well as an advantageous manufacturing method thereof.

The high-strength thin steel sheet in this disclosure is intended for a steel sheet having a thickness of 1 mm to 4 mm. In addition to a hot rolled steel sheet, the high-strength thin steel sheet in this disclosure also includes a steel sheet which has been subjected to surface treatment such as hot-dip galvanizing, galvannealing and electrogalvanization. Steel sheets obtained by subjecting the above-mentioned steel sheets to, for example, chemical conversion treatment to form a layer thereon are also included. Note that the sheet thickness does not include the thickness of planting or layer.

Solution to Problem

As a result of a keen study to solve the above problems, we discovered the following.

(1) Blanking workability can be significantly improved by having a certain composition and simultaneously precipitating fine precipitates of Ti, Nb, V and the like whose grain sizes are less than 20 nm and Fe precipitates such as cementite in an appropriate amount.

Regarding this mechanism, our consideration is as follows. Fe precipitates are precipitated, and these Fe precipitates serve as origins of cracks during blanking. Additionally, fine precipitates of Ti, Nb, V and the like promote propagation of the cracks. Therefore, it is considered that by precipitating Fe precipitates and fine precipitates of Ti, Nb, V and the like in an appropriate amount, end face cracking during blanking is suppressed, and accordingly, blanking workability is significantly improved.

Examples of fine precipitates of Ti, Nb, V and the like include carbide, composite carbide, carbonitride and composite carbonitride of Ti, Nb and V. Depending on the composition, it is Ti, Nb, V, Mo, Ta and W in some cases. Examples of Fe precipitates include cementite i.e. θ carbide and ε carbide.

(2) The ferrite grain size in the rolling direction of a steel sheet has a great influence on toughness. Particularly, the average grain size of top 5% large grain sizes greatly influences toughness. By appropriately controlling the average grain size of ferrite whose grain size is top 5% large according to tensile strength TS (MPa), toughness can be significantly improved.

Furthermore, since the above-mentioned fine precipitates of Ti, Nb, V and the like serve as origins of transition, toughness is further improved.

This disclosure is based on the aforementioned discoveries and further studies.

Specifically, the primary features of this disclosure are as described below.

1. A high-strength thin steel sheet comprising a chemical composition containing (consisting of), in mass %, C: 0.05% to 0.20%, Si: 0.6% to 1.5%, Mn: 1.3% to 3.0%, P: 0.10% or less, S: 0.030% or less, Al: 0.10% or less, N: 0.010% or less, and at least one selected from Ti: 0.01% to 1.00%, Nb: 0.01% to 1.00%, and V: 0.01% to 1.00%, the balance consisting of Fe and inevitable impurities, where a conversion value C* of total carbon contents in Ti, Nb and V precipitates whose grain sizes are less than 20 nm, defined by the following formula (1), is 0.010 mass % to 0.100 mass %, Fe content in Fe precipitates is 0.03 mass % to 0.50 mass %, and an average grain size of ferrite grains whose grain sizes are top 5% large in ferrite grain size distribution of rolling direction cross section is $(4000/TS)^2$ μm or less, the TS indicating tensile strength in unit of MPa, $$C^*=([Ti]/48+[Nb]/93+[V]/51)\times 12 \quad (1)$$

where [Ti], [Nb] and [V] each indicate contents of Ti, Nb and V in Ti, Nb and V precipitates whose grain sizes are less than 20 nm.

2. The high-strength thin steel sheet according to 1., where the composition further contains, in mass %, at least one selected from Mo: 0.005% to 0.50%, Ta: 0.005% to 0.50%, and W: 0.005% to 0.50%, a conversion value C of total carbon contents in Ti, Nb, V, Mo, Ta and W precipitates whose grain sizes are less than 20 nm, defined by the following formula (2), is 0.010 mass % to 0.100 mass %, $$C^{}=([Ti]/48+[Nb]/93+[V]/51+[Mo]/96+[Ta]/181+[W]/184)\times 12 \quad (2)$$

where [Ti], [Nb], [V], [Mo], [Ta] and [W] each indicate contents of Ti, Nb, V, Mo, Ta and W in Ti, Nb, V, Mo, Ta and W precipitates whose grain sizes are less than 20 nm.

3. The high-strength thin steel sheet according to 1. or 2., where the composition further contains, in mass %, at least one selected from Cr: 0.01% to 1.00%, Ni: 0.01% to 1.00%, and Cu: 0.01% to 1.00%.

4. The high-strength thin steel sheet according to any one of 1. to 3., where the composition further contains, in mass %, Sb: 0.005% to 0.050%.

5. The high-strength thin steel sheet according to any one of 1. to 4., where the composition further contains, in mass %, one or both selected from Ca: 0.0005% to 0.0100% and REM: 0.0005% to 0.0100%.

6. A method for manufacturing the high-strength thin steel sheet according to any one of 1. to 5., including:

hot rolling a steel slab having the composition according to any one of 1. to 5. to obtain a steel sheet, the hot rolling comprising rough rolling and finish rolling; and cooling and coiling the steel sheet after completing the finish rolling, where cumulative strain $R_t$ defined by the following formula (3) in the finish rolling is 1.3 or more and finisher delivery temperature is 820° C. or higher and lower than 930° C., the steel sheet is cooled down from the finisher delivery temperature to a temperature where slow cooling starts at an average cooling rate of 30° C./s or higher after completing the finish rolling, then slow cooling is started at a temperature of 750° C. to 600° C. where an average cooling rate is lower than 10° C./s and cooling time is 1 second to 10 seconds during the slow cooling, and the steel sheet is cooled down to a coiling temperature of 350° C. or higher and lower than 530° C. at an average cooling rate of 10° C./s or higher after completing the slow cooling, $$R_t = R_1 + R_2 + \ldots + R_m\left(=\sum_{n=1}^{m} R_n\right) \quad (3)$$

where $R_n$ is strain accumulated at an $n^{th}$ stand from upstream side when finish rolling is performed with m stands and is defined by the following formula, $$R_n=-\ln\left\langle 1-0.01\times r_n\times[1-0.01\times\exp\{-(11800+2\times10^3\times[C])/(T_n+273)+13.1-0.1\times[C]\}]\right\rangle$$

where $r_n$ is rolling reduction rate (%) at an $n^{th}$ stand from upstream side, $T_n$ is entry temperature (° C.) at an $n^{th}$ stand from upstream side, [C] is C content in mass % in steel, and n is an integer from 1 to m, provided that when $\exp\{-(11800+2\times10^3\times[C])/(T_n+273)+13.1-0.1\times[C]\}$ exceeds 100, a value thereof is set to be 100.

7. The method for manufacturing a high-strength thin steel sheet according to 6., where an additional work is performed with a sheet thickness reduction rate being 0.1% to 3.0% after the hot rolling.

Advantageous Effect

This disclosure provides a high-strength thin steel sheet having excellent blanking workability and toughness which are suitable for applications such as members for automobiles and various structural members, and therefore has an industrially significant advantageous effect.

BRIEF DESCRIPTION OF THE DRAWINGS

The disclosure will be further described below with reference to the accompanying drawings, where.

DETAILED DESCRIPTION

Figure 1:
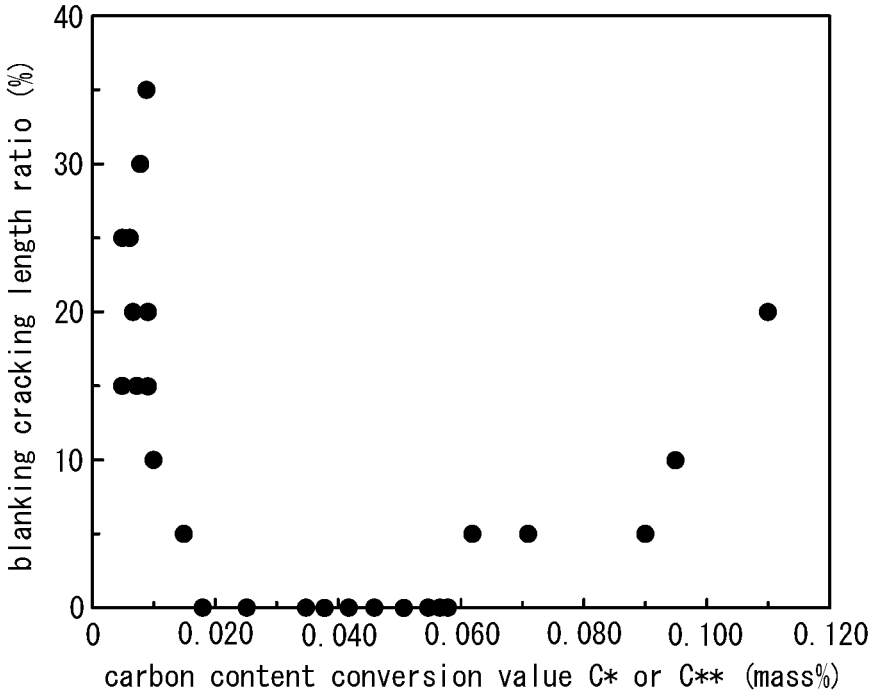
FIG. 1 illustrates the relationship between carbon content conversion value C* or C** and blanking cracking length ratio in examples and comparative examples where the carbon content conversion value C* or C is outside an appropriate range.

The following describes this disclosure in detail.

First, the chemical composition of the high-strength thin steel sheet of this disclosure will be described. Hereinafter, the unit "%" relating to the content of elements in the chemical composition refers to "mass %" unless specified otherwise.

C: 0.05% to 0.20%

C forms fine carbide, composite carbide, carbonitride and composite carbonitride of Ti, Nb, V and the like, which will be simply referred to as precipitates hereinafter, and contributes to improvement in strength, blanking workability and toughness. Additionally, C forms cementite with Fe, which also contributes to improvement in blanking workability. Therefore, C content should be 0.05% or more. On the other hand, C suppresses ferrite transformation, and accordingly an excessive amount of C suppresses formation of fine precipitates of Ti, Nb, V and the like. Additionally, an excessive amount of C forms too much cementite, leading to deterioration of toughness. Therefore, C content should be 0.20% or less. C content is preferably 0.15% or less. C content is more preferably 0.12% or less.

Si: 0.6% to 1.5%

Si accelerates ferrite transformation and promotes formation of fine precipitates of Ti, Nb, V and the like which precipitate simultaneously with the transformation during slow cooling performed in the cooling after hot rolling when manufacturing the steel sheet. Si also contributes to improvement in strength as a solid-solution-strengthening element without greatly deteriorating formability. To obtain these effects, Si content should be 0.6% or more. On the other hand, an excessive amount of Si accelerates the above-mentioned ferrite transformation too much. As a result, the precipitates of Ti, Nb, V and the like coarsen and eventually an appropriate amount of these fine precipitates cannot be obtained. Furthermore, not only toughness is deteriorated but also oxides of Si are likely to be formed on the surface of steel sheet, which accordingly tend to cause problems such as poor chemical conversion treatment on hot rolled steel sheets and non-coating on coated steel sheets. From this point of view, Si content should be 1.5% or less. Si content is preferably 1.2% or less.

Mn: 1.3% to 3.0%

Mn suppresses ferrite transformation before the start of slow cooling and suppresses coarsening of precipitates of Ti, Nb, V and the like during the cooling after hot rolling when manufacturing the steel sheet. Mn also contributes to improvement in strength by solid solution strengthening. Furthermore, M is bonded to harmful S in the steel to form MnS, thereby rendering the S harmless. To obtain these effects, Mn content should be 1.3% or more. Mn content is preferably 1.5% or more. On the other hand, an excessive amount of Mn leads to slab cracking, suppresses ferrite transformation, and suppresses formation of fine precipitates of Ti, Nb, V and the like. Therefore, Mn content should be 3.0% or less. Mn content is preferably 2.5% or less. Mn content is more preferably 2.0% or less.

P: 0.10% or less

P segregates at grain boundaries, deteriorating ductility and toughness. Additionally, a large amount of P accelerates ferrite transformation before the start of slow cooling and coarsens precipitates of Ti, Nb, V and the like during the cooling after hot rolling when manufacturing the steel sheet. Therefore, P content should be 0.10% or less. P content is preferably 0.05% or less. P content is more preferably 0.03% or less. P content is still more preferably 0.01% or less. The lower limit of P content is not particularly limited. However, since excessive removal of P leads to an increase in cost, the lower limit of P content is preferably 0.003%.

S: 0.030% or less

S decreases ductility during hot rolling, thereby inducing hot cracking and deteriorating surface characteristics. Additionally, S contributes little to strength, and, as an impurity element, leads to formation of coarse sulfide, thereby deteriorating ductility and stretch flangeability. For these reason, it is desirable to reduce S as much as possible. Therefore, S content should be 0.030% or less. S content is preferably 0.010% or less. S content is more preferably 0.003% or less. S content is still more preferably 0.001% or less. The lower limit of S content is not particularly limited. However, since excessive removal of S leads to an increase in cost, the lower limit of S content is preferably 0.0003%.

Al: 0.10% or less

When Al content exceeds 0.10%, toughness and weldability are greatly deteriorated. Additionally, Al oxide is likely to be formed on the surface, which may accordingly cause problems such as poor chemical conversion treatment on hot rolled steel sheets and non-coating on coated steel sheets. Therefore, Al content should be 0.10% or less. Al content is preferably 0.06% or less. Although the lower limit of Al content is not particularly limited, there is no problem if Al is contained in an amount of 0.01% or more as Al-killed steel.

N: 0.010% or less

Although N forms coarse nitrides at a high temperature with Ti, Nb, V and the like, these nitrides contribute little to strength. Therefore, a large amount of N lowers the effect of increasing strength of Ti, Nb, and V and deteriorates toughness. Additionally, since N causes slab cracking during hot rolling, surface flaws may occur. Thus, N content should be 0.010% or less. N content is preferably 0.005% or less. N content is more preferably 0.003% or less. N content is still more preferably 0.002% or less. The lower limit of N content is not particularly limited. However, since excessive removal of N leads to an increase in cost, the lower limit of N content is preferably 0.0010%.

At least one selected from Ti: 0.01% to 1.00%, Nb: 0.01% to 1.00% and V: 0.01% to 1.00%

Ti, Nb and V form fine precipitates with C, increasing strength and contributing to improvement in blanking workability and toughness. To obtain such effect, it is necessary to contain at least one selected from Ti, Nb and V, each at an amount of 0.01% or more. The amount is preferably 0.05% or more. On the other hand, even Ti, Nb and V are contained each at an amount of more than 1.00%, the effect of increasing strength will not be improved more. On the contrary, their fine precipitates excessively precipitate, deteriorating toughness and blanking workability. Therefore, contents of Ti, V and Nb should be each 1.00% or less. Contents of Ti, V and Nb are preferably each 0.80% or less.

In addition to the basic components described above, the high-strength thin steel sheet of this disclosure may also contain appropriate amounts of following elements in order to further improve the strength, blanking workability and toughness.

At least one selected from Mo: 0.005% to 0.50%, Ta: 0.005% to 0.50%, and W: 0.005% to 0.50%

Similar to Ti, Nb and V, Mo, Ta and W form fine precipitates with C, increasing strength and contributing to improvement in blanking workability and toughness. Therefore, when containing Mo, Ta and W, contents of Mo, Ta and W are preferably each 0.005% or more. Contents of Mo, Ta and W are more preferably each 0.01% or more. On the other hand, even Mo, Ta and W are contained each at an amount of more than 0.50%, the effect of increasing strength will not be improved more. On the contrary, their fine precipitates excessively precipitate, deteriorating toughness and blanking workability. Thus, when containing Mo, Ta and W, contents of Mo, Ta and W are preferably each 0.50% or less. Contents of Mo, Ta and W are more preferably each 0.40% or less.

At least one selected from Cr: 0.01% to 1.00%, Ni: 0.01% to 1.00% and Cu: 0.01% to 1.00%

Cr, Ni and Cu improve strength and toughness by refining the structure. Therefore, when containing Cr, Ni and Cu, contents of Cr, Ni and Cu are preferably each 0.01% or more. On the other hand, containing Cr, Ni and Cu each at an amount of more than 1.00% saturates the effect and increases cost. Thus, when containing Cr, Ni and Cu, contents of Cr, Ni and Cu are preferably each 1.00% or less.

Sb: 0.005% to 0.050%

Sb segregates on the surface during hot rolling, thereby preventing the slab from being nitrided and suppressing formation of coarse nitrides. Therefore, when containing Sb, Sb content is preferably 0.005% or more. On the other hand, containing Sb at an amount of more than 0.050% saturates the effect and increases cost. Thus, when containing Sb, Sb content is preferably 0.050% or less.

At least one or both selected from Ca: 0.0005% to 0.0100% and REM: 0.0005% to 0.0100%

Ca and REM improve ductility and stretch flangeability by controlling formation of sulfide. Therefore, when containing Ca and REM, contents of Ca and REM are preferably each 0.0005% or more. On the other hand, containing Ca and REM at an amount of more than 0.0100% saturates the effect and increases cost. Thus, when containing Ca and REM, Ca content and REM content are preferably each 0.0100% or less.

The balance other than the above components is Fe and inevitable impurities.

Next, the reason why the structure of the high-strength thin steel sheet of this disclosure is limited will be described. conversion value C* of total carbon contents in Ti, Nb and V precipitates whose grain sizes are less than 20 nm: 0.010 mass % to 0.100 mass %, or, conversion value C** of total carbon contents in Ti, Nb, V, Mo, Ta and W precipitates whose grain sizes are less than 20 nm: 0.010 mass % to 0.100 mass %

Ti, Nb and V precipitates whose grain sizes are less than 20 nm contribute to improvement in blanking workability and toughness. To obtain such effect, conversion value C* of total carbon contents in Ti, Nb and V precipitates whose grain sizes are less than 20 nm (hereinafter simply referred to as carbon content conversion value C*) should be 0.010 mass % or more. Carbon content conversion value C* is preferably 0.015 mass %.

On the other hand, an excessive amount of such precipitates deteriorates blanking workability and toughness because of the internal stress around the precipitates. Therefore, carbon content conversion value C* should be 0.100 mass % or less. Carbon content conversion value C* is preferably 0.080 mass % or less. Carbon content conversion value C* is more preferably 0.050 mass % or less.

Here, C* is calculated by the following formula (1).

$$C^*=([Ti]/48+[Nb]/93+[V]/51)\times 12 \quad (1)$$

where [Ti], [Nb] and [V] each indicate the contents of Ti, Nb and V in Ti, Nb and V precipitates whose grain sizes are less than 20 nm. In a case where Ti, Nb or V is not contained, [Ti], [Nb] or [V] is zero.

When the high-strength thin steel sheet of this disclosure contains Mo, Ta and W in addition to at least one selected from Ti, Nb and V, conversion value C of total carbon contents in Ti, Nb, V, Mo, Ta and W precipitates whose grain sizes are less than 20 nm (hereinafter simply referred to as carbon content conversion value C) defined by the following formula (2) is 0.010 mass % to 0.100 mass %. The preferred range of C** and its reason are similar to that of C*.

$$C^{**}=([Ti]/48+[Nb]/93+[V]/51+[Mo]/96+[Ta]/181+[W]/184)\times 12 \quad (2)$$

where [Ti], [Nb], [V], [Mo], [Ta], and [W] each indicate the contents of Ti, Nb, V, Mo, Ta and W in Ti, Nb, V, Mo, Ta and W precipitates whose grain sizes are less than 20 nm. In a case where Ti, Nb, V, Mo, Ta or W is not contained, [Ti], [Nb], [V], [Mo], [Ta] or [W] is zero. Note that when calculating C**, it is a prerequisite to satisfy the provision of C*.

Since Ti, Nb and V precipitates and the like whose grain sizes are 20 nm or more contribute little to improvement in blanking workability and toughness, this disclosure chooses Ti, Nb and V precipitates and the like whose grain sizes are less than 20 nm.

Fe content in Fe precipitates: 0.03 mass % to 0.50 mass %

Fe precipitates, particularly cementite, serve as origins of cracks during blanking and contribute to improvement in blanking workability. To obtain such effect, Fe content in Fe precipitates should be 0.03 mass % or more. Fe content in Fe precipitates is preferably 0.05 mass % or more. Fe content in Fe precipitates is more preferably 0.10 mass % or more. On the other hand, when Fe precipitates is excessive, the Fe precipitates may become origins of brittle fracture. Therefore, Fe content in Fe precipitates should be 0.50 mass % or less. Fe content in Fe precipitates is preferably 0.40 mass % or less. Fe content in Fe precipitates is more preferably 0.30 mass % or less.

Average grain size of ferrite grains whose grain sizes are top 5% large in ferrite grain size distribution of rolling direction cross section: $(4000/TS)^2$ μm less, the TS indicating tensile strength in unit of MPa A large average grain size of ferrite grains whose grain sizes are top 5% large in ferrite grain size distribution of rolling direction cross section greatly deteriorates toughness. Particularly, since toughness tends to decrease as tensile strength TS (MPa) increases, it is important to reduce the grain size according to tensile strength. Therefore, the average grain size of grain sizes that are top 5% large in ferrite grain size distribution of rolling direction cross section (hereinafter simply referred to as average grain size of top 5%) should be $(4000/TS\ (MPa))^2$ μm or less. The TS here is tensile strength of steel sheet in unit of MPa. The average grain size of top 5% is preferably $(3500/TS\ (MPa))^2$ μm or less. Note that TS is expressed in unit of MPa. When calculating the above $(4000/TS)^2$ and $(3500/TS)^2$, M is only used as Mantissa part rather than M ($=10^6$). For example, when TS is 780 MPa, values of $(4000/TS)^2$ and $(3500/TS)^2$ can be calculated with TS=780. Although the lower limit of the average grain size is not particularly limited, the lower limit is usually 5.0 μm.

The high-strength thin steel sheet of this disclosure preferably has a tensile strength TS of 780 MPa or more.

The structure of the high-strength thin steel sheet of this disclosure is preferably a structure mainly composed of ferrite, specifically, a structure composed of ferrite whose area ratio is 50% or more with respect to the entire structure and the balance. Structure other than ferrite may be bainite and martensite.

The following describes a method for manufacturing the high-strength thin steel sheet of this disclosure.

The method for manufacturing the high-strength thin steel sheet of this disclosure includes hot rolling a steel slab having the above-mentioned composition to obtain a steel sheet, the hot rolling comprising rough rolling and finish rolling, and cooling and coiling the steel sheet after completing the finish rolling.

When using this method, cumulative strain $R_t$ in the finish rolling is 1.3 or more, and finisher delivery temperature is 820° C. or higher and lower than 930° C. The steel sheet is cooled down from the finisher delivery temperature to a temperature where slow cooling starts at an average cooling rate of 30° C./s or higher after completing the finish rolling, then slow cooling is started at a temperature of 750° C. to 600° C. where an average cooling rate is lower than 10° C./s and cooling time is 1 second to 10 seconds during the slow cooling. After completing the slow cooling, the steel sheet is cooled down to a coiling temperature of 350° C. or higher and lower than 530° C. at an average cooling rate of 10° C./s or higher.

The reasons for limiting the manufacturing conditions will be described below. Note that the smelting method for obtaining a steel slab is not particularly limited and a publicly-known smelting method such as a converter, an electric heating furnace or the like can be adopted. After smelting, it is preferable to form steel slabs by a continuous casting method from the perspective of, for example, productivity, but adopting publicly-known casting methods such as ingot casting-blooming or thin slab continuous casting to form steel slabs is also acceptable.

Cumulative strain $R_t$ in finish rolling: 1.3 or more

By increasing cumulative strain $R_t$ during finish rolling, ferrite grain size of the hot rolled steel sheet obtained after hot rolling, cooling, and coiling can be reduced. Particularly, by setting the cumulative strain during finish rolling to 1.3 or more, it is possible to introduce uniform strain into the hot rolled steel sheet by finish rolling. As a result, it is possible to reduce variations in the grain size of ferrite grains in the rolling direction and reduce the average grain size of the top 5% ferrite grains. Therefore, cumulative strain $R_t$ during finish rolling should be 1.3 or more. Cumulative strain $R_t$ during finish rolling is preferably 1.5 or more. The upper limit of cumulative strain $R_t$ during finish rolling is not particularly limited. However, a too large cumulative strain may excessively accelerate ferrite transformation during the cooling after hot rolling and lead to coarsening of precipitates of Ti, Nb, V and the like. Therefore, cumulative strain $R_t$ during finish rolling is preferably 2.2 or less. Cumulative strain $R_t$ during finish rolling is more preferably 2.0 or less.

The cumulative strain $R_t$ during finish rolling is defined by the following formula (3), $$R_t = R_1 + R_2 + \ldots + R_m \left( = \sum_{n=1}^{m} R_n \right) \tag{3}$$

where $R_n$ is strain accumulated at an $n^{th}$ stand from upstream side when finish rolling is performed with m stands, and $R_n$ is defined by the following formula, $$R_n = \ln \langle 1 - 0.01 \times r_n \times [1 - 0.01 \times \exp\{-(11800 + 2 \times 10^3 \times [C])/(T_n + 273) + 13.1 - 0.1 \times [C]\}] \rangle$$

where $r_n$ is rolling reduction rate (%) at an $n^{th}$ stand from upstream side, $T_n$ is entry temperature (° C.) at an $n^{th}$ stand from upstream side, and [C] is C content in mass % in steel. Additionally, n is an integer from 1 to m, and m is usually 7. The rolling reduction rate $r_n$(%) is represented by $r_n = (t_{an} - t_{bn})/t_{an} \times 100$ where $t_{an}$ is the entrance side sheet thickness of $n^{th}$ stand and $t_{bn}$ is the exit side sheet thickness.

However, when $\exp\{-(11800 - 2 \times 10^3 \times [C])/(T_n + 273) + 13.1 - 0.1 \times [C]\}$ exceeds 100, the value is set to be 100.

Finisher delivery temperature: 820° C. or higher and lower than 930° C.

When finisher delivery temperature is lower than 820° C., ferrite transformation is accelerated before the start of slow cooling and precipitates of Ti, Nb, V and the like coarsen during the cooling after hot rolling. In a case where the finisher delivery temperature is in ferrite region, the precipitates of Ti, Nb, V and the like become coarser because of strain-induced precipitation. Additionally, ferrite crystal grains become elongated with a low temperature and cracks develop along the elongated grains, leading to significant deterioration of blanking workability. Therefore, finisher delivery temperature should be 820° C. or higher. Finisher delivery temperature is preferably 850° C. or higher. On the other hand, when finisher delivery temperature is 930° C. or higher, ferrite transformation is suppressed during the cooling after hot rolling, and formation of fine precipitates of Ti, Nb, V and the like is suppressed. Therefore, finisher delivery temperature should be lower than 930° C. Finisher delivery temperature is preferably lower than 900° C.

The finisher delivery temperature here is the exit side temperature (° C.) at an $m^{th}$ stand from upstream side when finish rolling is performed with m stands.

Average cooling rate from finisher delivery temperature to starting temperature of slow cooling: 30° C./s or higher When the average cooling rate from finisher delivery temperature to starting temperature of slow cooling is lower than 30° C./s, ferrite transformation is accelerated and precipitates of Ti, Nb, V and the like coarsen. Therefore, the average cooling rate from finisher delivery temperature to starting temperature of slow cooling should be 30° C./s or higher. The average cooling rate is preferably 50° C./s or higher. The average cooling rate is more preferably 80° C./s or higher. Although the upper limit of the average cooling rate is not particularly limited, it is about 200° C./s from the perspective of temperature control.

Starting temperature of slow cooling: 750° C. to 600° C.

When starting temperature of slow cooling exceeds 750° C., ferrite transformation takes place at a high temperature and ferrite crystal grains coarsen. Precipitates of Ti, Nb, V and the like also coarsen. Therefore, starting temperature of slow cooling should be 750° C. or lower. On the other hand, when starting temperature of slow cooling is lower than 600° C., precipitates of Ti, Nb, V and the like are not sufficient. Therefore, starting temperature of slow cooling should be 600° C. or higher.

Average cooling rate during slow cooling: lower than 10° C./s

When the average cooling rate during slow cooling is 10° C./s or higher, ferrite transformation is not sufficient and the amount of fine precipitates of Ti, Nb, V and the like decreases. Therefore, the average cooling rate during slow cooling should be lower than 10° C./s. The average cooling rate during slow cooling is preferably lower than 6° C./s. Although the lower limit of average cooling rate during slow cooling is not particularly limited, it can be about 2° C./s. The average cooling rate during slow cooling is preferably 4° C./s or higher.

Cooling time of slow cooling: 1 second to 10 seconds

When cooling time of slow cooling is less than 1 second, ferrite transformation is not sufficient and the amount of fine precipitates of Ti, Nb, V and the like decreases. Therefore, cooling time of slow cooling should be 1 second or more. Cooling time of slow cooling is preferably 2 seconds or more. Cooling time of slow cooling is more preferably 3 seconds or more. On the other hand, when cooling time of slow cooling exceeds 10 seconds, precipitates of Ti, Nb, V and the like coarsen. Ferrite crystal grains also coarsen. Therefore, cooling time of slow cooling should be 10 seconds or less. Cooling time of slow cooling is preferably 6 seconds or less.

Average cooling rate down to coiling temperature after slow cooling: 10° C./s or higher When the average cooling rate down to coiling temperature after slow cooling is lower than 10° C./s, precipitates of Ti, Nb, V and the like coarsen. Ferrite crystal grains also coarsen. Therefore, the average cooling rate down to coiling temperature after slow cooling should be 10° C./s or higher. The average cooling rate is preferably 30° C./s or higher. The average cooling rate is more preferably 50° C./s or higher. Although the upper limit of the average cooling rate is not particularly limited, it is about 100° C./s from the perspective of temperature control.

Coiling temperature: 350° C. or higher and less than 530° C.

When coiling temperature is 530° C. or higher, precipitates of Ti, Nb, V and the like coarsen. Ferrite crystal grains also coarsen. Therefore, coiling temperature should be lower than 530° C. Coiling temperature is preferably lower than 480° C. On the other hand, when coiling temperature is lower than 350° C., the generation of cementite, which is a precipitate of Fe and C, is suppressed. Therefore, coilng temperature should be 350° C. or higher.

Note that the above finisher delivery temperature, starting temperature of slow cooling and coiling temperature are all temperatures at the surface of steel sheet and that the average cooling rate is also specified based on the temperature at the surface of steel sheet.

After the hot rolling as described above, it is possible to perform an additional work with a sheet thickness reduction rate being 0.1% or higher to increase the number of mobile dislocations and to further improve blanking workability. The sheet thickness reduction rate is preferably 0.3% or higher. When the sheet thickness reduction rate exceeds 3.0%, however, dislocations are difficult to move because of the interaction between the dislocations, and blanking workability deteriorates. Therefore, the sheet thickness reduction rate is preferably 3.0% or lower when an additional work is performed after the hot rolling. The sheet thickness reduction rate is more preferably 2.0% or lower. The sheet thickness reduction rate is still more preferably 1.0% or lower.

The above-mentioned work may be a process of rolling by rolls or applying tensile to a steel sheet, or a combination of both.

Furthermore, composite plating of zinc plating and Al or composite plating of zinc and Al, composite plating of zinc and Ni, Al plating, composite plating of Al and Si, and the like may be applied to the steel sheet obtained as described above. A layer formed by chemical conversion treatment or the like is also acceptable.

EXAMPLES

Molten steel having the composition listed in Table 1 was obtained by a publicly-known smelting method and continuously cast to obtain steel slabs. These slabs were heated and subjected to rough rolling, and then finish rolling was performed under the conditions listed in Table 2. After the finish rolling, cooling and coiling were performed to obtain hot rolled steel sheets. The finish rolling was carried out by a hot rolling mill consisting of 7 stands. Additionally, some of the steel sheets were further subjected to reduction rolling at room temperature by a rolling roll.

TABLE 1

| | Chemical composition (mass %) | | | | | | | | | | | | | | |
|---|---|---|---|---|---|---|---|---|---|---|---|---|---|---|---|
| No. | C | Si | Mn | P | S | Al | N | Ti | Nb | V | Mo | Ta | W | Others | Remarks |
| 1 | 0.10 | 1.5 | 1.6 | 0.07 | 0.008 | 0.09 | 0.005 | 0.15 | 0.06 | 0.17 | — | — | — | Sb: 0.008 | Conforming steel |
| 2 | 0.14 | 0.7 | 1.7 | 0.01 | 0.001 | 0.06 | 0.003 | 0.10 | — | 0.21 | 0.42 | — | — | Sb: 0.012 | Conforming steel |
| 3 | 0.07 | 1.0 | 2.5 | 0.02 | 0.023 | 0.05 | 0.003 | 0.11 | 0.03 | 0.05 | 0.03 | 0.02 | 0.03 | — | Conforming steel |
| 4 | 0.17 | 1.0 | 2.1 | 0.02 | 0.002 | 0.04 | 0.006 | 0.06 | — | 0.55 | — | — | — | — | Conforming steel |
| 5 | 0.06 | 0.7 | 1.5 | 0.01 | 0.001 | 0.05 | 0.003 | 0.25 | — | — | — | — | — | — | Conforming steel |
| 6 | 0.15 | 0.5 | 1.9 | 0.01 | 0.001 | 0.04 | 0.007 | 0.05 | — | 0.55 | — | — | — | — | Comparative steel |
| 7 | 0.06 | 1.0 | 1.7 | 0.01 | 0.003 | 0.03 | 0.004 | 0.21 | 0.05 | — | — | — | — | — | Conforming steel |
| 8 | 0.15 | 1.6 | 1.5 | 0.03 | 0.021 | 0.04 | 0.005 | 0.06 | — | 0.52 | — | — | — | — | Comparative steel |
| 9 | 0.11 | 0.8 | 1.7 | 0.02 | 0.001 | 0.03 | 0.004 | 0.05 | — | 0.25 | — | — | — | — | Conforming steel |
| 10 | 0.19 | 1.2 | 1.6 | 0.01 | 0.002 | 0.04 | 0.005 | — | — | 0.77 | — | — | — | — | Conforming steel |
| 11 | 0.12 | 1.0 | 1.4 | 0.11 | 0.001 | 0.04 | 0.008 | 0.09 | — | 0.35 | — | — | — | — | Comparative steel |
| 12 | 0.15 | 0.7 | 1.9 | 0.09 | 0.007 | 0.05 | 0.004 | 0.09 | — | 0.54 | — | — | 0.05 | Ca: 0.0040 | Conforming steel |
| 13 | 0.08 | 1.2 | 2.8 | 0.04 | 0.018 | 0.06 | 0.005 | 0.15 | — | 0.15 | — | — | — | Cr: 0.03 | Conforming steel |
| 14 | 0.08 | 1.2 | 1.2 | 0.01 | 0.004 | 0.08 | 0.006 | 0.07 | — | 0.15 | — | — | — | — | Comparative steel |
| 15 | 0.05 | 1.3 | 1.4 | 0.02 | 0.001 | 0.06 | 0.005 | 0.19 | — | — | — | — | — | — | Conforming steel |
| 16 | 0.09 | 1.2 | 1.2 | 0.02 | 0.011 | 0.02 | 0.005 | 0.12 | — | 0.21 | — | — | — | — | Comparative steel |
| 17 | 0.12 | 1.1 | 1.4 | 0.01 | 0.002 | 0.03 | 0.005 | 0.05 | — | 0.22 | 0.35 | — | — | — | Conforming steel |
| 18 | 0.11 | 1.1 | 1.6 | 0.01 | 0.002 | 0.03 | 0.005 | 0.11 | — | 0.25 | — | — | — | — | Conforming steel |
| 19 | 0.18 | 1.1 | 1.7 | 0.01 | 0.001 | 0.05 | 0.004 | 0.05 | — | 0.65 | — | — | — | — | Conforming steel |
| 20 | 0.11 | 1.0 | 1.5 | 0.01 | 0.001 | 0.04 | 0.004 | 0.14 | — | 0.27 | — | — | — | — | Conforming steel |
| 21 | 0.06 | 0.8 | 2.0 | 0.05 | 0.003 | 0.06 | 0.005 | 0.15 | — | — | 0.05 | — | — | — | Conforming steel |
| 22 | 0.12 | 1.1 | 1.5 | 0.01 | 0.003 | 0.04 | 0.004 | 0.19 | — | 0.28 | — | — | — | Ca: 0.0060, REM: 0.0070 | Conforming steel |
| 23 | 0.16 | 0.8 | 2.1 | 0.03 | 0.015 | 0.06 | 0.005 | 0.07 | — | 0.41 | 0.34 | 0.03 | 0.06 | Cr: 0.06, Ni: 0.08, Cu: 0.07, Sb: 0.010, Ca: 0.0030, REM: 0.0050 | Conforming steel |
| 24 | 0.12 | 1.2 | 3.1 | 0.01 | 0.003 | 0.05 | 0.004 | 0.08 | 0.05 | — | 0.32 | — | — | — | Comparative steel |
| 25 | 0.11 | 1.5 | 1.5 | 0.01 | 0.001 | 0.05 | 0.004 | 0.11 | — | 0.25 | — | — | — | Ca: 0.0080 | Conforming steel |
| 26 | 0.12 | 1.7 | 1.4 | 0.01 | 0.001 | 0.07 | 0.004 | 0.07 | 0.05 | 0.35 | — | — | — | — | Comparative steel |
| 27 | 0.09 | 0.9 | 2.0 | 0.01 | 0.001 | 0.04 | 0.003 | 0.11 | — | 0.22 | — | — | — | — | Conforming steel |

TABLE 1-continued

| No. | Chemical composition (mass %) | | | | | | | | | | | | | | Remarks |
|---|---|---|---|---|---|---|---|---|---|---|---|---|---|---|---|
| | C | Si | Mn | P | S | Al | N | Ti | Nb | V | Mo | Ta | W | Others | |
| 28 | 0.13 | 1.6 | 1.5 | 0.03 | 0.003 | 0.03 | 0.005 | — | — | 0.51 | — | — | — | — | Comparative steel |
| 29 | 0.07 | 0.8 | 1.8 | 0.01 | 0.001 | 0.04 | 0.003 | 0.15 | — | 0.15 | — | — | — | — | Conforming steel |
| 30 | 0.08 | 0.8 | 1.8 | 0.01 | 0.002 | 0.05 | 0.006 | 0.09 | — | 0.21 | — | — | — | Cr: 0.05 | Conforming steel |
| 31 | 0.20 | 1.0 | 1.4 | 0.01 | 0.001 | 0.06 | 0.005 | — | — | 0.95 | — | — | — | — | Conforming steel |
| 32 | 0.05 | 0.6 | 1.7 | 0.02 | 0.028 | 0.03 | 0.004 | 0.05 | 0.02 | 0.05 | — | — | — | — | Conforming steel |
| 33 | 0.22 | 0.9 | 1.6 | 0.02 | 0.002 | 0.06 | 0.006 | 0.06 | 0.05 | 0.89 | 0.22 | — | — | — | Comparative steel |
| 34 | 0.09 | 1.4 | 2.2 | 0.05 | 0.013 | 0.07 | 0.008 | 0.12 | — | 0.25 | — | — | — | Cr: 0.05, Ni: 0.06, Cu: 0.05 | Conforming steel |
| 35 | 0.04 | 1.1 | 1.5 | 0.01 | 0.001 | 0.05 | 0.004 | 0.16 | — | — | — | — | — | Cr: 0.04 | Comparative steel |
| 36 | 0.13 | 0.9 | 1.6 | 0.01 | 0.002 | 0.03 | 0.005 | 0.09 | — | 0.21 | 0.31 | — | — | Cr: 0.05 | Conforming steel |
| 37 | 0.11 | 1.3 | 1.3 | 0.08 | 0.005 | 0.05 | 0.003 | 0.14 | — | 0.31 | — | — | — | Ca: 0.0080 | Conforming steel |
| 38 | 0.19 | 1.2 | 1.8 | 0.01 | 0.001 | 0.05 | 0.003 | — | — | 1.10 | — | — | — | — | Comparative steel |

Underline indicates that it is outside an appropriate range.

TABLE 2

| No. | Conditions of hot rolling, cooling and coiling | | | | | | | | | | | | | | | | | | | |
|---|---|---|---|---|---|---|---|---|---|---|---|---|---|---|---|---|---|---|---|---|
| | $r_1$ (%) | $T_1$ (° C.) | $R_1$ | $r_2$ (%) | $T_2$ (° C.) | $R_2$ | $r_3$ (%) | $T_3$ (° C.) | $R_3$ | $r_4$ (%) | $T_4$ (° C.) | $R_4$ | $r_5$ (%) | $T_5$ (° C.) | $R_5$ | $r_6$ (%) | $T_6$ (° C.) | $R_6$ | $r_7$ (%) | $T_7$ (° C.) |
| 1 | 41 | 1040 | 0.22 | 41 | 1020 | 0.25 | 38 | 1000 | 0.26 | 35 | 980 | 0.26 | 31 | 960 | 0.25 | 30 | 950 | 0.25 | 22 | 940 |
| 2 | 52 | 990 | 0.42 | 41 | 980 | 0.33 | 37 | 970 | 0.3 | 26 | 960 | 0.21 | 29 | 940 | 0.25 | 27 | 920 | 0.25 | 21 | 910 |
| 3 | 49 | 1050 | 0.23 | 46 | 1030 | 0.26 | 40 | 1020 | 0.24 | 25 | 1000 | 0.16 | 25 | 970 | 0.18 | 22 | 960 | 0.17 | 15 | 940 |
| 4 | 47 | 1020 | 0.33 | 38 | 1010 | 0.27 | 35 | 990 | 0.27 | 24 | 980 | 0.18 | 27 | 970 | 0.22 | 25 | 950 | 0.21 | 17 | 940 |
| 5 | 48 | 950 | 0.42 | 40 | 940 | 0.35 | 40 | 930 | 0.36 | 28 | 920 | 0.25 | 25 | 910 | 0.22 | 25 | 900 | 0.23 | 16 | 890 |
| 6 | 49 | 980 | 0.41 | 41 | 960 | 0.36 | 37 | 940 | 0.34 | 27 | 930 | 0.24 | 27 | 910 | 0.25 | 25 | 880 | 0.24 | 15 | 870 |
| 7 | 50 | 1030 | 0.28 | 42 | 1010 | 0.26 | 38 | 1000 | 0.25 | 27 | 980 | 0.19 | 23 | 970 | 0.17 | 22 | 950 | 0.17 | 16 | 940 |
| 8 | 48 | 950 | 0.45 | 45 | 940 | 0.43 | 38 | 930 | 0.36 | 25 | 910 | 0.23 | 23 | 880 | 0.22 | 25 | 870 | 0.25 | 17 | 850 |
| 9 | 48 | 1000 | 0.35 | 40 | 990 | 0.3 | 36 | 980 | 0.28 | 25 | 960 | 0.2 | 22 | 950 | 0.18 | 22 | 930 | 0.19 | 19 | 910 |
| 10 | 51 | 950 | 0.50 | 45 | 930 | 0.45 | 43 | 900 | 0.46 | 27 | 880 | 0.27 | 23 | 870 | 0.23 | 25 | 850 | 0.26 | 21 | 840 |
| 11 | 47 | 980 | 0.38 | 38 | 970 | 0.31 | 34 | 960 | 0.28 | 27 | 940 | 0.23 | 25 | 930 | 0.22 | 24 | 920 | 0.21 | 15 | 910 |
| 12 | 41 | 980 | 0.33 | 40 | 970 | 0.34 | 37 | 960 | 0.32 | 21 | 940 | 0.18 | 25 | 930 | 0.22 | 26 | 920 | 0.24 | 15 | 900 |
| 13 | 40 | 1010 | 0.26 | 40 | 990 | 0.29 | 41 | 980 | 0.31 | 34 | 970 | 0.26 | 35 | 950 | 0.29 | 24 | 940 | 0.2 | 21 | 930 |
| 14 | 47 | 1000 | 0.33 | 41 | 980 | 0.31 | 35 | 970 | 0.27 | 31 | 950 | 0.25 | 28 | 930 | 0.24 | 22 | 910 | 0.19 | 18 | 890 |
| 15 | 47 | 980 | 0.35 | 41 | 960 | 0.33 | 38 | 950 | 0.31 | 26 | 930 | 0.22 | 25 | 910 | 0.22 | 24 | 890 | 0.22 | 19 | 880 |
| 16 | 52 | 990 | 0.40 | 40 | 980 | 0.31 | 35 | 960 | 0.28 | 29 | 940 | 0.25 | 25 | 930 | 0.21 | 21 | 920 | 0.18 | 16 | 900 |
| 17 | 49 | 980 | 0.40 | 39 | 960 | 0.33 | 37 | 940 | 0.33 | 24 | 920 | 0.21 | 27 | 910 | 0.25 | 24 | 890 | 0.23 | 18 | 880 |
| 18 | 49 | 950 | 0.45 | 39 | 930 | 0.36 | 38 | 910 | 0.37 | 27 | 880 | 0.26 | 25 | 860 | 0.25 | 23 | 840 | 0.23 | 19 | 830 |
| 19 | 48 | 980 | 0.41 | 42 | 960 | 0.38 | 44 | 940 | 0.43 | 26 | 920 | 0.24 | 24 | 900 | 0.23 | 26 | 880 | 0.26 | 19 | 860 |
| 20 | 49 | 960 | 0.43 | 38 | 950 | 0.33 | 38 | 930 | 0.35 | 30 | 910 | 0.28 | 27 | 910 | 0.25 | 22 | 890 | 0.21 | 17 | 880 |
| 21 | 51 | 1030 | 0.28 | 39 | 1020 | 0.23 | 41 | 1010 | 0.26 | 25 | 990 | 0.17 | 27 | 980 | 0.19 | 24 | 960 | 0.18 | 15 | 940 |
| 22 | 49 | 970 | 0.42 | 43 | 960 | 0.37 | 39 | 950 | 0.34 | 31 | 940 | 0.27 | 26 | 930 | 0.23 | 25 | 920 | 0.22 | 20 | 910 |
| 23 | 46 | 1060 | 0.24 | 41 | 1050 | 0.23 | 39 | 1030 | 0.25 | 20 | 1000 | 0.14 | 25 | 980 | 0.19 | 26 | 960 | 0.21 | 16 | 940 |
| 24 | 45 | 1010 | 0.31 | 40 | 990 | 0.3 | 33 | 980 | 0.25 | 26 | 970 | 0.20 | 24 | 950 | 0.20 | 25 | 930 | 0.22 | 16 | 920 |
| 25 | 48 | 1020 | 0.31 | 39 | 1010 | 0.26 | 40 | 990 | 0.3 | 27 | 980 | 0.20 | 24 | 970 | 0.18 | 23 | 960 | 0.18 | 18 | 940 |
| 26 | 51 | 1010 | 0.36 | 41 | 1000 | 0.29 | 37 | 980 | 0.29 | 28 | 970 | 0.22 | 26 | 950 | 0.21 | 23 | 940 | 0.19 | 19 | 920 |
| 27 | 46 | 1010 | 0.31 | 41 | 990 | 0.30 | 35 | 970 | 0.27 | 27 | 960 | 0.21 | 23 | 940 | 0.19 | 23 | 920 | 0.20 | 16 | 900 |
| 28 | 51 | 960 | 0.46 | 42 | 950 | 0.38 | 36 | 930 | 0.33 | 28 | 920 | 0.25 | 24 | 900 | 0.22 | 23 | 880 | 0.22 | 16 | 860 |
| 29 | 50 | 1040 | 0.26 | 45 | 1030 | 0.25 | 32 | 1020 | 0.18 | 24 | 1010 | 0.14 | 22 | 990 | 0.15 | 20 | 970 | 0.14 | 15 | 950 |
| 30 | 46 | 970 | 0.37 | 42 | 950 | 0.36 | 41 | 930 | 0.38 | 28 | 920 | 0.25 | 24 | 900 | 0.22 | 25 | 890 | 0.23 | 18 | 870 |
| 31 | 45 | 1000 | 0.36 | 41 | 990 | 0.33 | 38 | 970 | 0.33 | 29 | 960 | 0.25 | 26 | 950 | 0.23 | 25 | 930 | 0.23 | 18 | 920 |
| 32 | 45 | 1000 | 0.30 | 42 | 980 | 0.31 | 35 | 970 | 0.26 | 33 | 960 | 0.26 | 25 | 950 | 0.2 | 25 | 940 | 0.2 | 20 | 930 |
| 33 | 48 | 1020 | 0.36 | 39 | 1000 | 0.31 | 35 | 980 | 0.29 | 28 | 960 | 0.24 | 24 | 940 | 0.21 | 25 | 920 | 0.23 | 20 | 900 |
| 34 | 45 | 980 | 0.35 | 41 | 970 | 0.33 | 42 | 960 | 0.35 | 38 | 940 | 0.34 | 32 | 930 | 0.28 | 30 | 920 | 0.27 | 22 | 910 |
| 35 | 50 | 1050 | 0.21 | 38 | 1030 | 0.19 | 38 | 1010 | 0.23 | 30 | 1000 | 0.19 | 25 | 980 | 0.17 | 24 | 960 | 0.18 | 19 | 940 |
| 36 | 46 | 1000 | 0.34 | 41 | 990 | 0.31 | 38 | 970 | 0.31 | 33 | 950 | 0.28 | 27 | 940 | 0.23 | 26 | 930 | 0.23 | 19 | 920 |
| 37 | 55 | 1020 | 0.37 | 40 | 1010 | 0.27 | 36 | 990 | 0.26 | 35 | 980 | 0.27 | 32 | 970 | 0.25 | 26 | 960 | 0.21 | 17 | 940 |
| 38 | 49 | 950 | 0.48 | 39 | 940 | 0.37 | 40 | 930 | 0.39 | 27 | 920 | 0.25 | 24 | 910 | 0.22 | 25 | 900 | 0.24 | 17 | 880 |

| No. | Conditions of hot rolling, cooling and coiling | | | | | | | | | | |
|---|---|---|---|---|---|---|---|---|---|---|---|
| | $R_7$ | $R_t$ | Finisher delivery temperature (° C.) | Average cooling rate down to slow cooling starting temperature (° C./s) | Slow cooling starting temperature (° C.) | Average cooling rate during slow cooling (° C./s) | Cooling time of slow cooling (s) | Average cooling rate down to coiling temperature (° C./s) | Coiling temperature (° C.) | Additional work Sheet thickness reduction rate (%) | Remarks |
| 1 | 0.18 | 1.7 | 920 | 200 | 600 | 5 | 7 | 20 | 490 | — | Example |
| 2 | 0.19 | 2.0 | 890 | 100 | 640 | 5 | 3 | 40 | 450 | 2.5 | Example |

TABLE 2-continued

| | | | | | | | | | | | |
|---|---|---|---|---|---|---|---|---|---|---|---|
| 3 | 0.12 | 1.3 | 920 | 100 | 620 | 2 | 5 | 70 | 450 | — | Example |
| 4 | 0.14 | 1.6 | 920 | 40 | 700 | 5 | 3 | 50 | 380 | — | Example |
| 5 | 0.14 | 2.0 | 880 | 70 | 650 | 4 | 4 | 35 | 450 | — | Example |
| 6 | 0.14 | 2.0 | 860 | 80 | 650 | 6 | 6 | 40 | 440 | 0.3 | Comparative Example |
| 7 | 0.13 | 1.4 | 930 | 80 | 670 | 5 | 4 | 25 | 480 | — | Comparative Example |
| 8 | 0.17 | 2.1 | 830 | 80 | 650 | 10 | 4 | 40 | 380 | — | Comparative Example |
| 9 | 0.17 | 1.7 | 890 | 85 | 640 | 7 | 5 | 10 | 530 | — | Comparative Example |
| 10 | 0.21 | 2.4 | 820 | 60 | 640 | 4 | 4 | 60 | 420 | 0.3 | Example |
| 11 | 0.13 | 1.8 | 890 | 80 | 640 | 4 | 5 | 30 | 460 | — | Comparative Example |
| 12 | 0.13 | 1.8 | 890 | 90 | 630 | 5 | 6 | 35 | 440 | — | Example |
| 13 | 0.18 | 1.8 | 915 | 120 | 630 | 7 | 10 | 25 | 500 | 0.5 | Example |
| 14 | 0.16 | 1.8 | 875 | 75 | 630 | 7 | 6 | 20 | 490 | — | Comparative Example |
| 15 | 0.17 | 1.8 | 860 | 35 | 760 | 8 | 6 | 40 | 460 | — | Comparative Example |
| 16 | 0.14 | 1.8 | 885 | 70 | 660 | 5 | 0.4 | 25 | 470 | — | Comparative Example |
| 17 | 0.17 | 1.9 | 860 | 70 | 650 | 4 | 5 | 9 | 510 | 0.2 | Comparative Example |
| 18 | 0.19 | 2.1 | 810 | 75 | 620 | 7 | 5 | 35 | 430 | 0.5 | Comparative Example |
| 19 | 0.19 | 2.1 | 840 | 70 | 680 | 6 | 3 | 20 | 490 | — | Example |
| 20 | 0.16 | 2.0 | 870 | 75 | 660 | 4 | 3 | 30 | 460 | — | Example |
| 21 | 0.12 | 1.4 | 925 | 30 | 750 | 5 | 2 | 50 | 470 | — | Example |
| 22 | 0.18 | 2.0 | 880 | 90 | 650 | 5 | 4 | 15 | 510 | — | Example |
| 23 | 0.13 | 1.4 | 925 | 80 | 650 | 4 | 4 | 40 | 580 | — | Example |
| 24 | 0.14 | 1.6 | 905 | 55 | 700 | 3 | 4 | 25 | 480 | 0.1 | Comparative Example |
| 25 | 0.15 | 1.6 | 920 | 25 | 740 | 4 | 6 | 30 | 480 | — | Comparative Example |
| 26 | 0.16 | 1.7 | 900 | 75 | 660 | 4 | 11 | 35 | 400 | — | Comparative Example |
| 27 | 0.14 | 1.6 | 880 | 55 | 670 | 5 | 4 | 90 | 340 | — | Comparative Example |
| 28 | 0.15 | 2.0 | 855 | 65 | 630 | 5 | 5 | 30 | 450 | — | Comparative Example |
| 29 | 0.11 | 1.2 | 925 | 70 | 650 | 5 | 4 | 30 | 450 | — | Comparative Example |
| 30 | 0.17 | 2.0 | 855 | 150 | 590 | 3 | 5 | 45 | 360 | 0.1 | Comparative Example |
| 31 | 0.16 | 1.9 | 900 | 50 | 680 | 5 | 6 | 45 | 400 | — | Example |
| 32 | 0.16 | 1.7 | 910 | 50 | 720 | 3 | 1 | 10 | 520 | 0.1 | Example |
| 33 | 0.19 | 1.8 | 880 | 70 | 640 | 4 | 4 | 35 | 460 | — | Comparative Example |
| 34 | 0.20 | 2.1 | 895 | 150 | 610 | 9 | 8 | 100 | 350 | — | Example |
| 35 | 0.15 | 1.3 | 920 | 80 | 650 | 3 | 3 | 25 | 480 | — | Comparative Example |
| 36 | 0.17 | 1.9 | 900 | 70 | 650 | 3 | 3 | 25 | 470 | — | Example |
| 37 | 0.14 | 1.8 | 920 | 80 | 670 | 4 | 5 | 35 | 480 | 1.5 | Example |
| 38 | 0.16 | 2.1 | 870 | 60 | 650 | 5 | 4 | 35 | 450 | — | Comparative Example |

Underline indicates that it is outside an appropriate range.

Test pieces were taken from the resulting steel sheets and subjected to the following evaluations (i) to (vi), (i) measurement of conversion value C* of total carbon contents in Ti, Nb and V precipitates whose grain sizes are less than 20 nm or conversion value C** of total carbon contents in Ti, Nb, V, Mo, Ta and W precipitates whose grain sizes are less than 20 nm, (ii) measurement of Fe content in Fe precipitates, (iii) measurement of average grain size of ferrite grains whose grain sizes are top 5% large in ferrite grain size distribution of rolling direction cross section, (iv) tensile test, (v) blanking test, and (vi) evaluation of toughness.

The evaluation results are listed in Table 3. Evaluation methods are as stated below.

(i) measurement of conversion value C* of total carbon contents in Ti, Nb and V precipitates whose grain sizes are less than 20 nm or conversion value C** of total carbon contents in Ti, Nb, V, Mo, Ta and W precipitates whose grain sizes are less than 20 nm As described in JP 4737278 B, constant current electrolysis was carried out in a 10% AA electrolytic solution, which was a 10 vol % electrolytic solution of acetylacetone-1 mass % of tetramethylammonium chloride-methanol, using a test piece taken from the steel sheet as the anode, and the electrolytic solution was filtered with a filter whose pore size is 20 nm after a certain amount of the test piece was dissolved. Subsequently, contents of Ti, Nb and B as well as contents of Mo, Ta and W in the resulting filtrate were obtained by ICP emission spectroscopy analysis, and carbon content conversion value C* or carbon content conversion value C** was calculated by the above formula (1) or (2) with the obtained results.

(ii) measurement of Fe content in Fe precipitates

Constant current electrolysis was carried out in a 10% AA electrolytic solution using a test piece taken from the steel sheet as the anode, and a certain amount of the test piece was dissolved. Subsequently, extraction residue obtained by the electrolysis was filtered with a filter whose pore size is 0.2 μm to recover Fe precipitates. After dissolving the obtained Fe precipitates with mixed acid, Fe was quantified by ICP emission spectroscopy analysis, and Fe content in the Fe precipitates was calculated with the measurement result.

Since the Fe precipitates are in an agglomerated state, Fe precipitates whose grain sizes are less than 0.2 μm also can be recovered by filtering the Fe precipitates with a filter having a pore size of 0.2 μm.

(iii) measurement of average grain size of ferrite grains whose grain sizes are top 5% large in ferrite grain size distribution of rolling direction A cross section of rolling direction-sheet thickness direction was embedded in resin and polished. After subjecting the cross section to nital etching, EBSD (Electron Backscatter Diffraction) measurement was made at three locations with a step size of 0.1 μm in an area of 100 μm×100 μm where the center is the ¼ sheet thickness position, a position corresponding to ¼ of the sheet thickness in the depth direction from the surface of the steel sheet, and ferrite grain size distribution in the rolling direction was obtained with a setting where an orientation difference of 15° or more is the grain boundary.

All of the steel sheets obtained as described above had a structure mainly composed of ferrite, which means the area ratio of ferrite is 50% or more. The area ratio of ferrite can be obtained by embedding the cross section of rolling direction-sheet thickness direction in resin, polishing the cross section, subjecting the cross section to nital etching, observing three visual fields at 3000 times magnification under an SEM (Scanning Electron Microscope) on the ¼ sheet thickness position, calculating the area ratio of constituent phase in the obtained structure micrograph for three visual fields, and averaging the values. Ferrite appears as a gray structure i.e. base steel structure in the above-mentioned structure micrograph.

Additionally, ferrite grain size distribution in the rolling direction cross section was obtained by the so-called section method, in which nine lines are drawn at equal intervals parallel to the rolling direction for each measurement location in the EBSD measurement and the section length of each ferrite grain in the rolling direction is measured. The average value of the measured section lengths was taken as the average grain size of ferrite grains in the rolling direction. The average value of grain sizes of ferrite grains up to 5% in an order from the largest grain size was taken as the average grain size of top 5% large grain sizes. When selecting the ferrite grains whose grain sizes are top 5% large, ferrite grains having a grain size of less than 0.1 μm were excluded. Additionally, in order to obtain the ferrite grain size distribution, 200 or more ferrite grains were measured to obtain their grain sizes.

(vi) tensile test

In tensile test, a JIS No. 5 tensile test piece was cut out with the longitudinal direction being the direction orthogonal to the rolling direction. The tensile test was carried out according to JIS Z 2241, and yield strength YP, tensile strength TS, and total elongation El were evaluated.

(v) blanking test

Blanking workability was evaluated by blanking a hole having a diameter of 10 mm three times at a time with a clearance of 20%, observing the blanked end face all around and calculating the average value of perimeter ratio of the portion where cracking had occurred (hereinafter also referred to as blanking cracking length ratio). When the blanking cracking length ratio is 10% or less, blanking workability can be considered as excellent.

(iv) evaluation of toughness

The evaluation conditions were set according to JIS Z 2242 except the sheet thickness, which was the original thickness as listed in Table 3, and a DBTT (Ductile-brittle Transition Temperature) was obtained by Charpy impact test. The V-notch test piece here was made so that the longitudinal direction was in the direction orthogonal to the rolling direction. When the DBTT (Ductile-brittle Transition Temperature) is lower than −40° C., toughness can be considered as excellent.

TABLE 3

| | | Steel structure | | | | | |
|---|---|---|---|---|---|---|---|
| | Sheet | | Fe content in Fe | Average grain size of ferrite | Average grain size of ferrite whose grain size is top 5% | Tensile test | |
| No. | thickness (mm) | C* or C** (mass %) | precipitates (mass %) | in rolling direction (μm) | large in rolling direction (μm) | YP (MPa) | TS (MPa) |
| 1 | 2.9 | 0.055 | 0.13 | 6.9 | 14.6 | 760 | 860 |
| 2 | 2.4 | 0.038 | 0.22 | 5.2 | 12.8 | 880 | 1010 |
| 3 | 2.0 | 0.025 | 0.08 | 10.8 | 23.1 | 720 | 820 |
| 4 | 2.3 | 0.058 | 0.31 | 5.2 | 10.1 | 1020 | 1190 |
| 5 | 2.9 | 0.018 | 0.05 | 8.6 | 17.6 | 770 | 840 |
| 6 | 3.2 | 0.008 | 0.25 | 4.6 | 8.6 | 1060 | 1210 |
| 7 | 2.6 | 0.005 | 0.06 | 11.0 | 23.5 | 730 | 810 |
| 8 | 2.9 | 0.008 | 0.21 | 5.3 | 10.1 | 1050 | 1180 |
| 9 | 2.3 | 0.009 | 0.11 | 7.2 | 20.5 | 800 | 900 |
| 10 | 2.6 | 0.090 | 0.35 | 4.5 | 8.1 | 1100 | 1280 |
| 11 | 2.6 | 0.009 | 0.18 | 6.9 | 12.5 | 920 | 1040 |
| 12 | 2.6 | 0.071 | 0.26 | 5.3 | 10.7 | 950 | 1200 |
| 13 | 4.0 | 0.035 | 0.07 | 8.8 | 18.3 | 730 | 850 |
| 14 | 2.6 | 0.008 | 0.09 | 7.6 | 19.8 | 720 | 820 |
| 15 | 2.3 | 0.008 | 0.03 | 11.8 | 27.8 | 750 | 810 |
| 16 | 2.6 | 0.007 | 0.13 | 7.9 | 18.3 | 780 | 890 |
| 17 | 2.4 | 0.009 | 0.12 | 7.2 | 17.6 | 802 | 990 |
| 18 | 2.5 | 0.009 | 0.16 | 8.2 | 14.3 | 820 | 990 |
| 19 | 2.1 | 0.071 | 0.33 | 4.8 | 9.5 | 1060 | 1220 |
| 20 | 2.6 | 0.051 | 0.15 | 6.8 | 13.2 | 850 | 1020 |

TABLE 3-continued

| | | | | | | | |
|---|---|---|---|---|---|---|---|
| 21 | 2.6 | 0.015 | 0.04 | 11.2 | 22.5 | 720 | 810 |
| 22 | 2.3 | 0.046 | 0.16 | 5.2 | 10.9 | 920 | 1080 |
| 23 | 2.8 | 0.062 | 0.28 | 5.3 | 9.5 | 1050 | 1230 |
| 24 | 2.5 | 0.007 | 0.19 | 8.1 | 16.8 | 760 | 910 |
| 25 | 2.9 | 0.008 | 0.17 | 9.8 | 14.6 | 830 | 950 |
| 26 | 2.5 | 0.009 | 0.16 | 7.1 | 16.3 | 880 | 1030 |
| 27 | 2.8 | 0.025 | 0.02 | 7.6 | 17.9 | 790 | 890 |
| 28 | 2.9 | 0.006 | 0.20 | 4.8 | 8.9 | 1020 | 1170 |
| 29 | 2.2 | 0.021 | 0.07 | 10.9 | 20.1 | 800 | 920 |
| 30 | 3.2 | 0.005 | 0.09 | 7.2 | 15.6 | 780 | 900 |
| 31 | 2.9 | 0.095 | 0.45 | 3.9 | 8.2 | 1160 | 1350 |
| 32 | 3.2 | 0.010 | 0.03 | 9.6 | 19.3 | 710 | 780 |
| 33 | 3.2 | 0.009 | 0.55 | 4.3 | 8.5 | 1080 | 1320 |
| 34 | 3.6 | 0.057 | 0.10 | 7.5 | 15.9 | 710 | 840 |
| 35 | 2.9 | 0.008 | 0.02 | 9.8 | 22.3 | 710 | 790 |
| 36 | 2.3 | 0.042 | 0.18 | 5.6 | 11.9 | 1000 | 1100 |
| 37 | 2.6 | 0.042 | 0.15 | 5.3 | 12.8 | 880 | 1060 |
| 38 | 2.5 | 0.110 | 0.35 | 3.9 | 7.9 | 1250 | 1320 |

| | Tensile test | | Blanking test Blanking cracking | Evaluation of toughness | |
|---|---|---|---|---|---|
| No. | El (%) | $(4000/TS)^2$ | length ratio (%) | DBTT (° C.) | Remarks |
| 1 | 18 | 21.6 | 0 | −80 | Example |
| 2 | 17 | 15.7 | 0 | −80 | Example |
| 3 | 19 | 23.8 | 0 | −100 | Example |
| 4 | 16 | 11.3 | 0 | −40 | Example |
| 5 | 18 | 22.7 | 0 | −120 | Example |
| 6 | 14 | 10.9 | 15 | −20 | Comparative Example |
| 7 | 18 | 24.4 | 15 | −30 | Comparative Example |
| 8 | 15 | 11.5 | 15 | −30 | Comparative Example |
| 9 | 17 | 19.8 | 20 | 0 | Comparative Example |
| 10 | 14 | 9.8 | 5 | −40 | Example |
| 11 | 16 | 14.8 | 15 | −30 | Comparative Example |
| 12 | 15 | 11.1 | 5 | −40 | Example |
| 13 | 18 | 22.1 | 0 | −80 | Example |
| 14 | 18 | 23.8 | 20 | −20 | Comparative Example |
| 15 | 18 | 24.4 | 20 | 10 | Comparative Example |
| 16 | 17 | 20.2 | 15 | −20 | Comparative Example |
| 17 | 17 | 16.3 | 20 | −10 | Comparative Example |
| 18 | 16 | 16.3 | 35 | −20 | Comparative Example |
| 19 | 15 | 10.7 | 5 | −50 | Example |
| 20 | 17 | 15.4 | 0 | −80 | Example |
| 21 | 19 | 24.4 | 5 | −90 | Example |
| 22 | 17 | 13.7 | 0 | −60 | Example |
| 23 | 15 | 10.6 | 5 | −40 | Example |
| 24 | 17 | 19.3 | 20 | −20 | Comparative Example |
| 25 | 17 | 17.7 | 20 | −20 | Comparative Example |
| 26 | 16 | 15.1 | 20 | 0 | Comparative Example |
| 27 | 16 | 20.2 | 15 | −40 | Comparative Example |
| 28 | 14 | 11.7 | 25 | −30 | Comparative Example |
| 29 | 17 | 18.9 | 5 | −30 | Comparative Example |
| 30 | 17 | 19.8 | 25 | −20 | Comparative Example |
| 31 | 13 | 8.8 | 10 | −40 | Example |
| 32 | 20 | 26.3 | 10 | −80 | Example |
| 33 | 13 | 9.2 | 20 | 10 | Comparative Example |
| 34 | 19 | 22.7 | 0 | −90 | Example |
| 35 | 18 | 25.6 | 30 | 20 | Comparative Example |
| 36 | 16 | 13.2 | 0 | −50 | Example |
| 37 | 17 | 14.2 | 0 | −50 | Example |
| 38 | 14 | 9.2 | 20 | −10 | Comparative Example |

Underline indicates that it is outside an appropriate range.

According to Table 3, it is understood that a high-strength thin steel sheet having excellent blanking workability and toughness as well as a high strength where the tensile strength TS is 780 MPa or more can be obtained in all examples.

Figure 2:
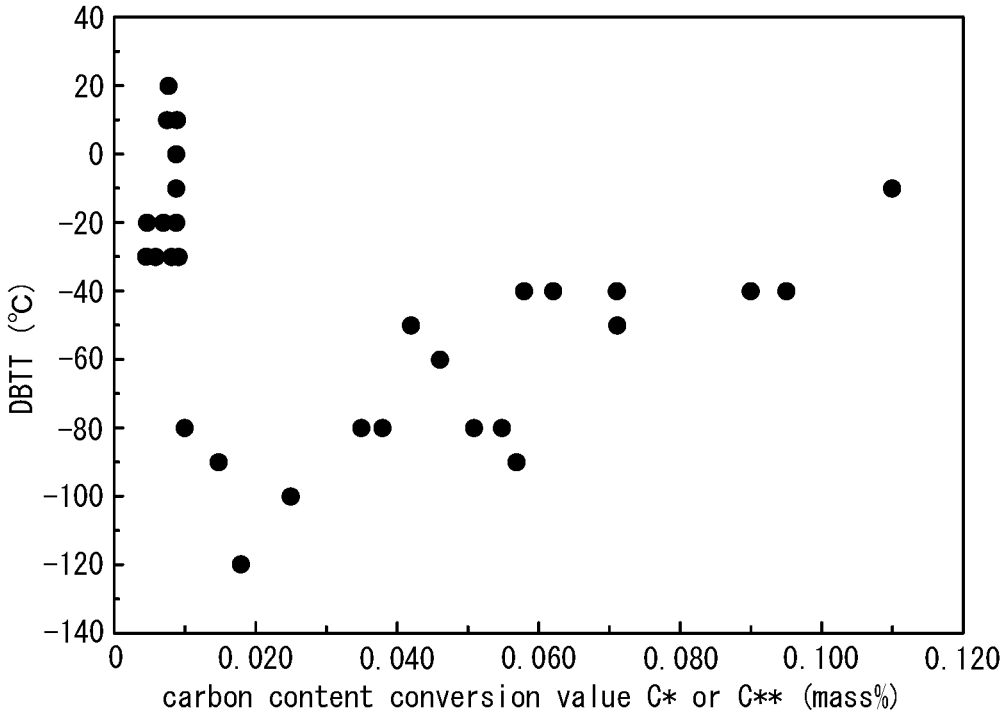
FIG. 2** illustrates the relationship between carbon content conversion value C* or C** and DBTT in examples and comparative examples where the carbon content conversion value C* or C is outside an appropriate range.

Additionally, FIGS. 1 and 2 each illustrate the relationship between carbon content conversion value C* or C** and DBTT, and the relationship between carbon content conversion value C* or C** and blanking cracking length ratio in examples and comparative examples where the carbon content conversion value C* or C** is outside an appropriate range.

According to FIGS. 1 and 2, it is understood that DBTT is −40° C. or lower and blanking cracking length ratio is 10% or less when content conversion value C* or C** is in a range of 0.010 mass % to 0.100 mass %.

Figure 3:
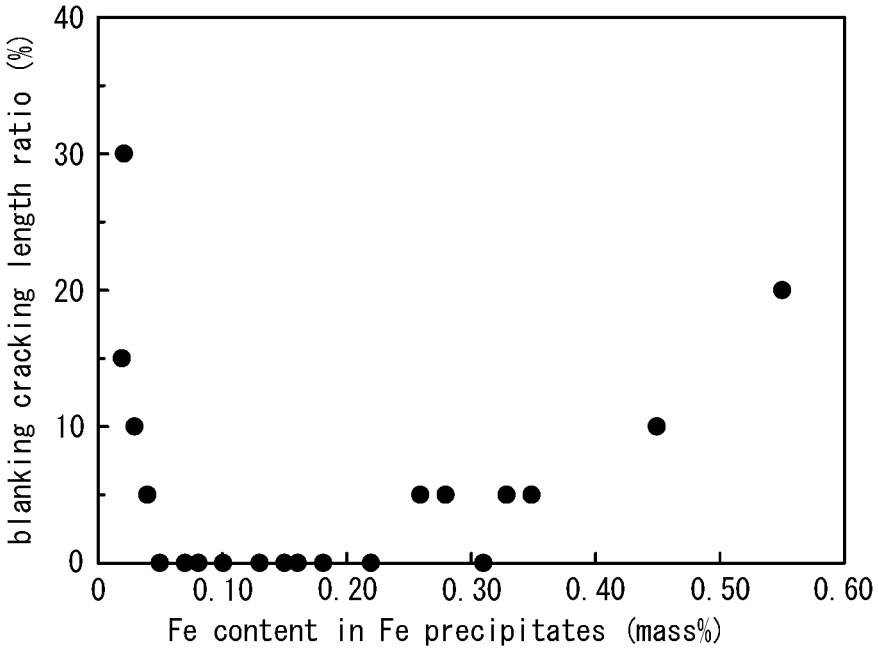
FIG. 3 illustrates the relationship between Fe content in Fe precipitates and blanking cracking length ratio in examples and comparative examples where the Fe content in Fe precipitates is outside an appropriate range.

Furthermore, FIG. 3 illustrates the relationship between Fe content in Fe precipitates and blanking cracking length ratio in examples and comparative examples where the Fe content in Fe precipitates is outside an appropriate range.

According to FIG. 3, it is understood that by controlling Fe content in Fe precipitates to a range of 0.03 mass % to 0.50 mass %, blanking cracking length ratio can be 10% or less.

Figure 4:
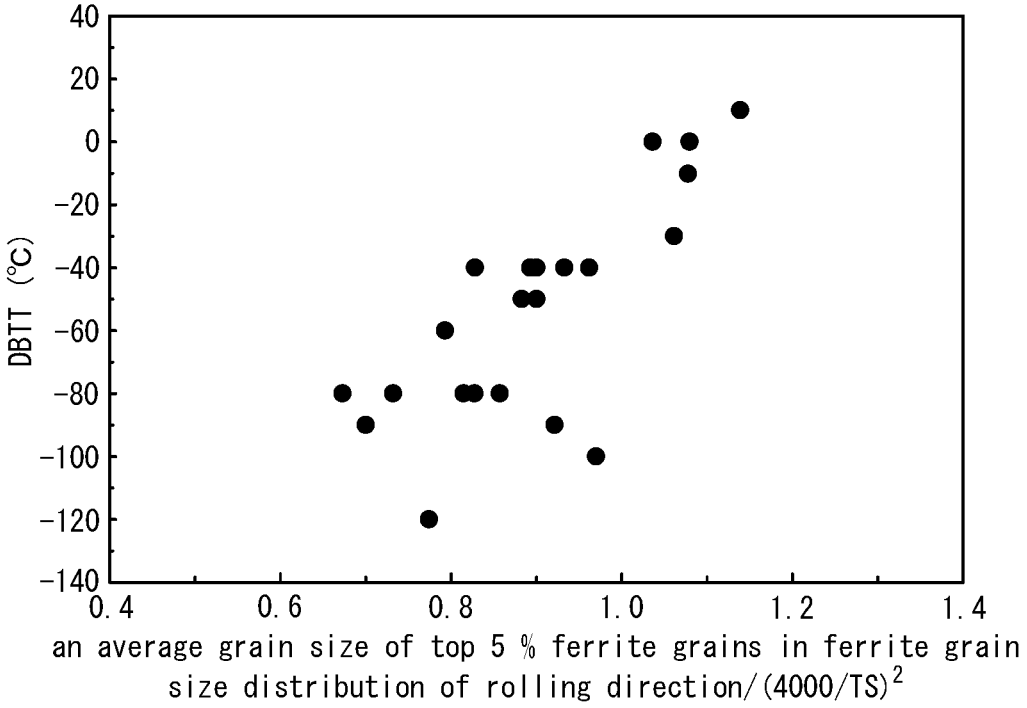
FIG. 4** illustrates the relationship between (an average grain size of top 5% ferrite grains in ferrite grain size distribution of rolling direction cross section)/$(4000/TS)^2$ and DBTT in examples and comparative examples where the average grain size of top 5% ferrite grains in ferrite grain size distribution of rolling direction is outside an appropriate range.

Moreover, FIG. 4 illustrates the relationship between (an average grain size of top 5% ferrite grains in ferrite grain size distribution of rolling direction)/$(4000/TS)^2$ and DBTT in examples and comparative examples where the average grain size of top 5% ferrite grains in ferrite grain size distribution of rolling direction cross section is outside an appropriate range.

According to FIG. 4, it is understood that DBTT is −40° C. or lower when (an average grain size of top 5% ferrite grains in ferrite grain size distribution of rolling direction cross section)/$(4000/TS)^2$ is 1.0 or less, in other words, DBTT is −40° C. or lower when an average grain size of top 5% ferrite grains in ferrite grain size distribution of rolling direction cross section is $(4000/TS)^2$ μm or less in relation to tensile strength TS in unit of MPa.

The invention claimed is:

1. A steel sheet comprising a chemical composition containing, in mass %, C: 0.05% to 0.20%, Si: 0.6% to 1.5%, Mn: 1.3% to 3.0%, P: 0.10% or less, S: 0.030% or less, Al: 0.10% or less, N: 0.010% or less, and at least one selected from Ti: 0.01% to 1.00%, Nb: 0.01% to 1.00%, and V: 0.01% to 1.00%, the balance consisting of Fe and inevitable impurities, wherein a conversion value C* of total carbon contents in Ti, Nb and V precipitates whose grain sizes are less than 20 nm, defined by the following formula (1), is 0.010 mass % to 0.100 mass %, Fe content in Fe precipitates is 0.03 mass % to 0.50 mass %, and an average grain size of ferrite grains whose grain sizes are top 5% large in ferrite grain size distribution of rolling direction cross section is $(4000/TS)^2$ μm or less, the TS indicating tensile strength in unit of MPa, $$C^*=([Ti]/48+[Nb]/93+[V]/51)\times 12 \quad (1)$$

where [Ti], [Nb] and [V] each indicate contents of Ti, Nb and V in Ti, Nb and V precipitates whose grain sizes are less than 20 nm.

2. The steel sheet according to claim 1, wherein the composition further comprises, in mass %, at least one selected from Mo: 0.005% to 0.50%, Ta: 0.005% to 0.50%, and W: 0.005% to 0.50%, a conversion value C of total carbon contents in Ti, Nb, V, Mo, Ta and W precipitates whose grain sizes are less than 20 nm, defined by the following formula (2), is 0.010 mass % to 0.100 mass %, $$C^{}=([Ti]/48+[Nb]/93+[V]/51+[Mo]/96+[Ta]/181+[W]/184)\times 12 \quad (2)$$

where [Ti], [Nb], [V], [Mo], [Ta] and [W] each indicate contents of Ti, Nb, V, Mo, Ta and W in Ti, Nb, V, Mo, Ta and W precipitates whose grain sizes are less than 20 nm.

3. The steel sheet according to claim 1, wherein the composition further comprises, in mass %, at least one selected from groups (a) to (c):

(a) at least one selected from Cr: 0.01% to 1.00%, Ni: 0.01% to 1.00%, and Cu: 0.01% to 1.00%;

(b) Sb: 0.005% to 0.050%; and (c) one or both selected from Ca: 0.0005% to 0.0100% and REM: 0.0005% to 0.0100%.

4. The steel sheet according to claim 2, wherein the composition further comprises, in mass %, at least one selected from groups (a) to (c):

(a) at least one selected from Cr: 0.01% to 1.00%, Ni: 0.01% to 1.00%, and Cu: 0.01% to 1.00%;

(b) Sb: 0.005% to 0.050%; and (c) one or both selected from Ca: 0.0005% to 0.0100% and REM: 0.0005% to 0.0100%.

5. A method for manufacturing the steel sheet according to claim 1, comprising:

hot rolling a steel slab having the composition according to claim 1 to obtain a steel sheet, the hot rolling comprising rough rolling and finish rolling; and cooling and coiling the steel sheet after completing the finish rolling, wherein cumulative strain $R_t$ defined by the following formula (3) in the finish rolling is 1.3 or more and finisher delivery temperature is 820° C. or higher and lower than 930° C., the steel sheet is cooled down from the finisher delivery temperature to a temperature where slow cooling starts at an average cooling rate of 30° C./s or higher after completing the finish rolling, then slow cooling is started at a temperature of 750° C. to 600° C. where an average cooling rate is lower than 10° C./s and cooling time is 1 second to 10 seconds during the slow cooling, and the steel sheet is cooled down to a coiling temperature of 350° C. or higher and lower than 530° C. at an average cooling rate of 10° C./s or higher after completing the slow cooling, $$R_t = R_1 + R_2 + \ldots + R_m\left(=\sum_{n=1}^{m} R_n\right) \quad (3)$$

where $R_n$ is strain accumulated at an $n^{th}$ stand from upstream side when finish rolling is performed with m stands and is defined by the following formula, $$R_n=\ln\langle 1-0.01\times r_n\times[1-0.01\times\exp\{-(11800+2\times 10^3\times[C])/(T_n+273)+13.1-0.1\times[C]\}]\rangle$$

where $r_n$ is rolling reduction rate (%) at an $n^{th}$ stand from upstream side, $T_n$ is entry temperature (° C.) at an $n^{th}$ stand from upstream side, [C] is C content in mass % in steel, and n is an integer from 1 to m, provided that when exp $\{1-(11800+2\times 10^3\times[C])/(T_n+273)+13.1-0.1\times[C]\}$ exceeds 100, a value thereof is set to be 100 thereby producing the steel sheet of claim 1.

6. The method for manufacturing a steel sheet according to claim 5, wherein an additional work is performed with a sheet thickness reduction rate being 0.1% to 3.0% after the hot rolling.

7. A method for manufacturing the steel sheet according to claim 2, comprising:

hot rolling a steel slab having the composition according to claim 2 to obtain a steel sheet, the hot rolling comprising rough rolling and finish rolling; and cooling and coiling the steel sheet after completing the finish rolling, wherein cumulative strain $R_t$ defined by the following formula (3) in the finish rolling is 1.3 or more and finisher delivery temperature is 820° C. or higher and lower than 930° C., the steel sheet is cooled down from the finisher delivery temperature to a temperature where slow cooling starts at an average cooling rate of 30° C./s or higher after completing the finish rolling, then slow cooling is started at a temperature of 750° C. to 600° C. where an average cooling rate is lower than 10° C./s and cooling time is 1 second to 10 seconds during the slow cooling, and the steel sheet is cooled down to a coiling temperature of 350° C. or higher and lower than 530° C. at an average cooling rate of 10° C./s or higher after completing the slow cooling, $$R_t = R_1 + R_2 + \ldots + R_m \left( = \sum_{n=1}^{m} R_n \right) \quad (3)$$

where $R_n$ is strain accumulated at an $n^{th}$ stand from upstream side when finish rolling is performed with m stands and is defined by the following formula, $$R_n = -\ln \langle 1-0.01\times r_n \times [1-0.01\times \exp\{-(11800+2\times 10^3\times [C])/(T_n+273)+13.1-0.1\times [C]\}]\rangle$$

where $r_n$ is rolling reduction rate (%) at an $n^{th}$ stand from upstream side, $T_n$ is entry temperature (° C.) at an $n^{th}$ stand from upstream side, [C] is C content in mass % in steel, and n is an integer from 1 to m, provided that when $\exp\{-(11800+2\times 10^3\times [C])/(T_n+273)+13.1-0.1\times [C]\}$ exceeds 100, a value thereof is set to be 100 thereby producing the steel sheet of claim 2.

8. The method for manufacturing a steel sheet according to claim 7, wherein an additional work is performed with a sheet thickness reduction rate being 0.1% to 3.0% after the hot rolling.

9. A method for manufacturing the steel sheet according to claim 3, comprising:

hot rolling a steel slab having the composition according to claim 8 to obtain a steel sheet, the hot rolling comprising rough rolling and finish rolling; and cooling and coiling the steel sheet after completing the finish rolling, wherein cumulative strain $R_t$ defined by the following formula (3) in the finish rolling is 1.3 or more and finisher delivery temperature is 820° C. or higher and lower than 930° C., the steel sheet is cooled down from the finisher delivery temperature to a temperature where slow cooling starts at an average cooling rate of 30° C./s or higher after completing the finish rolling, then slow cooling is started at a temperature of 750° C. to 600° C. where an average cooling rate is lower than 10° C./s and cooling time is 1 second to 10 seconds during the slow cooling, and the steel sheet is cooled down to a coiling temperature of 350° C. or higher and lower than 530° C. at an average cooling rate of 10° C./s or higher after completing the slow cooling, $$R_t = R_1 + R_2 + \ldots + R_m \left( = \sum_{n=1}^{m} R_n \right) \quad (3)$$

where $R_n$ is strain accumulated at an $n^{th}$ stand from upstream side when finish rolling is performed with m stands and is defined by the following formula, $$R_n = -\ln \langle 1-0.01\times r_n \times [1-0.01\times \exp\{-(11800+2\times 10^3\times [C])/(T_n+273)+13.1-0.1\times [C]\}]\rangle$$

where $r_n$ is rolling reduction rate (%) at an $n^{th}$ stand from upstream side, $T_n$ is entry temperature (° C.) at an $n^{th}$ stand from upstream side, [C] is C content in mass % in steel, and n is an integer from 1 to m, provided that when $\exp\{-(11800+2\times 10^3\times [C])/(T_n+273)+13.1-0.1\times [C]\}$ exceeds 100, a value thereof is set to be 100 thereby producing the steel sheet of claim 8.

10. The method for manufacturing a steel sheet according to claim 9, wherein an additional work is performed with a sheet thickness reduction rate being 0.1% to 3.0% after the hot rolling.

11. A method for manufacturing the steel sheet according to claim 3, comprising:

hot rolling a steel slab having the composition according to claim 4 to obtain a steel sheet, the hot rolling comprising rough rolling and finish rolling; and cooling and coiling the steel sheet after completing the finish rolling, wherein cumulative strain $R_t$ defined by the following formula (3) in the finish rolling is 1.3 or more and finisher delivery temperature is 820° C. or higher and lower than 930° C., the steel sheet is cooled down from the finisher delivery temperature to a temperature where slow cooling starts at an average cooling rate of 30° C./s or higher after completing the finish rolling, then slow cooling is started at a temperature of 750° C. to 600° C. where an average cooling rate is lower than 10° C./s and cooling time is 1 second to 10 seconds during the slow cooling, and the steel sheet is cooled down to a coiling temperature of 350° C. or higher and lower than 530° C. at an average cooling rate of 10° C./s or higher after completing the slow cooling, $$R_t = R_1 + R_2 + \ldots + R_m \left( = \sum_{n=1}^{m} R_n \right) \quad (3)$$

where $R_n$ is strain accumulated at an $n^{th}$ stand from upstream side when finish rolling is performed with m stands and is defined by the following formula, $$R_n = -\ln \langle 1-0.01\times r_n \times [1-0.01\times \exp\{-(11800+2\times 10^3\times [C])/(T_n+273)+13.1-0.1\times [C]\}]\rangle$$

where $r_n$ is rolling reduction rate (%) at an $n^{th}$ stand from upstream side, $T_n$ is entry temperature (° C.) at an $n^{th}$ stand from upstream side, [C] is C content in mass % in steel, and n is an integer from 1 to m, provided that when $\exp\{-(11800+2\times 10^3\times [C])/(T_n+273)+13.1-0.1\times [C]\}$ exceeds 100, a value thereof is set to be 100 thereby producing the steel sheet of claim 9.

12. The method for manufacturing a steel sheet according to claim 11, wherein an additional work is performed with a sheet thickness reduction rate being 0.1% to 3.0% after the hot rolling.

* * * * *